US005209272A

United States Patent [19]

Riesen et al.

[11] Patent Number: 5,209,272

[45] Date of Patent: May 11, 1993

[54] GRIPPER CHANGER FOR PROJECTILE LOOMS

[75] Inventors: Peter Riesen, Elgg; Marc Gianotti, Wiesendangen, both of Switzerland

[73] Assignee: Sulzer Brothers Limited, Winterthur, Switzerland

[21] Appl. No.: 860,385

[22] Filed: Mar. 30, 1992

[30] Foreign Application Priority Data

May 23, 1991 [CH] Switzerland ..... 01528/91

[51] Int. Cl.[5] ..... D03D 47/24

[52] U.S. Cl. ..... 139/438; 139/196.2; 139/453

[58] Field of Search ..... 416/223 R; 139/438, 139/439, 196.2, 453, 437, 443, 444, 445

[56] References Cited

U.S. PATENT DOCUMENTS 4,313,472 1/1980 Weidmann ..... 139/453 X
4,896,971 1/1990 Weetman et al. ..... 416/223 R X
4,936,355 6/1990 Jankovsky ..... 139/453
5,031,671 7/1991 Riesen ..... 139/453

FOREIGN PATENT DOCUMENTS 0333647 9/1989 European Pat. Off. .
0409773 1/1991 European Pat. Off. .
942979 11/1955 Fed. Rep. of Germany .
2812776 9/1979 Fed. Rep. of Germany ... 416/223 R
9105700 5/1991 World Int. Prop. O. ..... 416/223 R

*Primary Examiner*—Andrew M. Falik
*Attorney, Agent, or Firm*—Townsend and Townsend

[57] ABSTRACT

A weft yarn changer on a projectile loom has a pivoted changer member (1) for at least two yarn transfer elements (2) each in the form of a slide rod (2*a*) and a yarn gripper (21). Slide bars for the yarn transfer elements (2) are provided on the changer member (1) and are connected by at least one lightweight plastics holder to a tube effective as a drive shaft of the changer member or as a pivot spindle. The inventive weft yarn changer yields reduced actuation times.

12 Claims, 2 Drawing Sheets

Fig.1a (PRIOR ART)
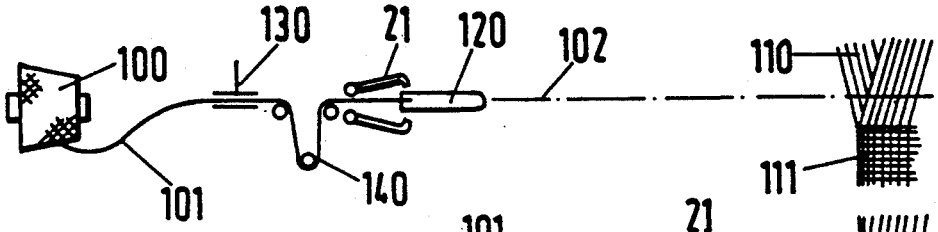
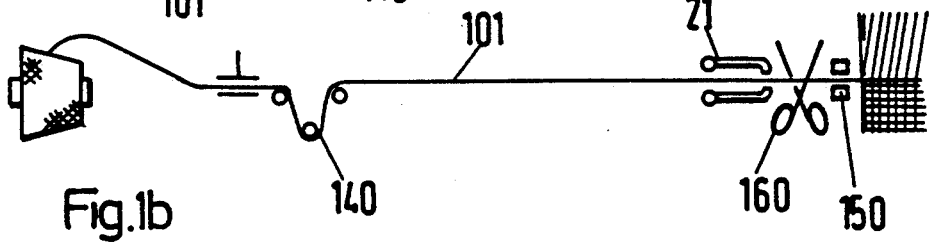
Fig.1b
(PRIOR ART)
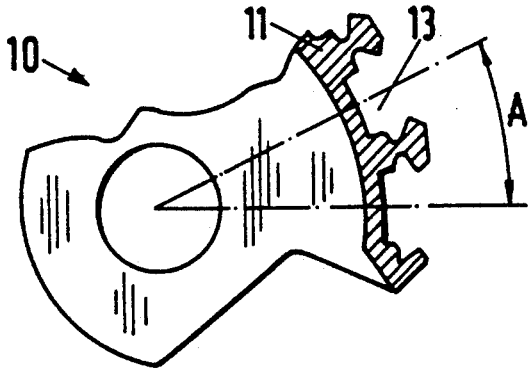
Fig.4
(PRIOR ART)
Fig.2 (PRIOR ART)
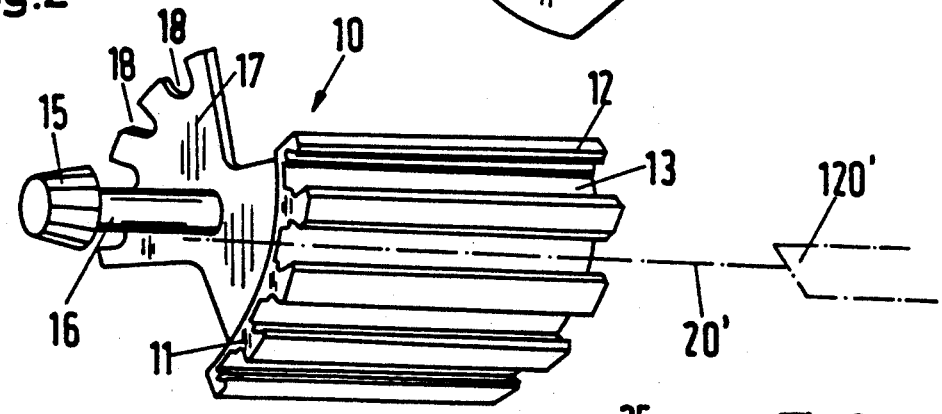
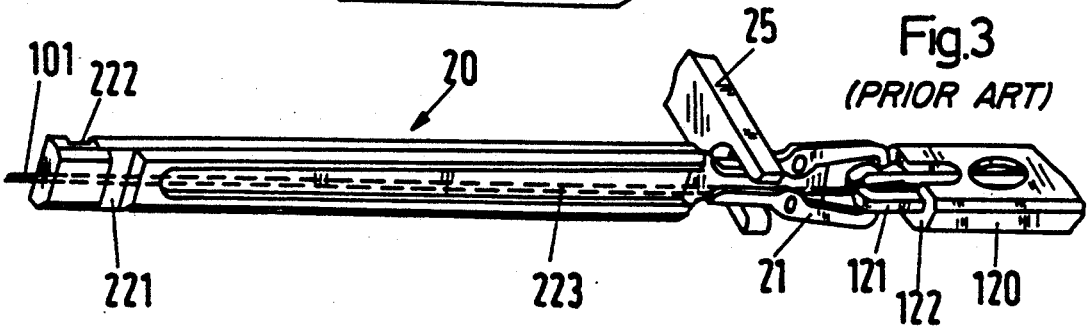
Fig.3
(PRIOR ART)

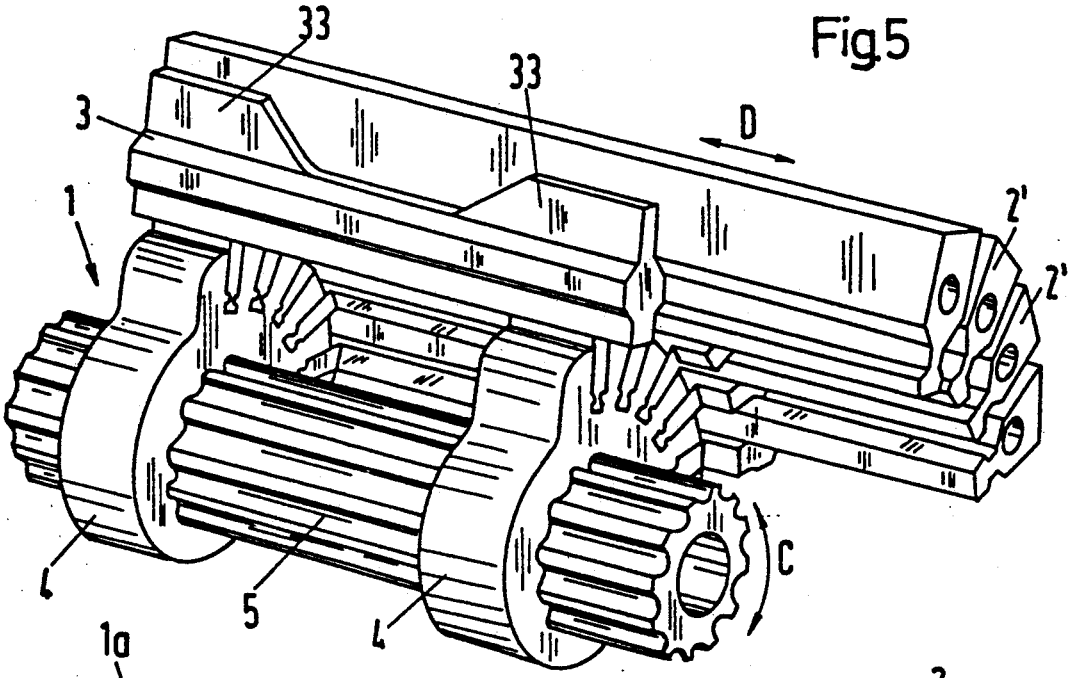
Fig.5
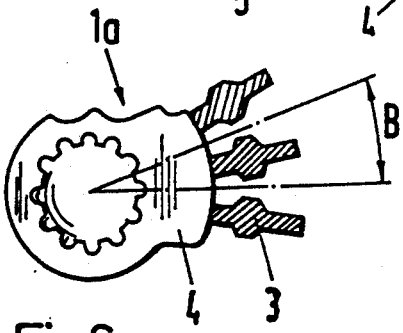
Fig.6
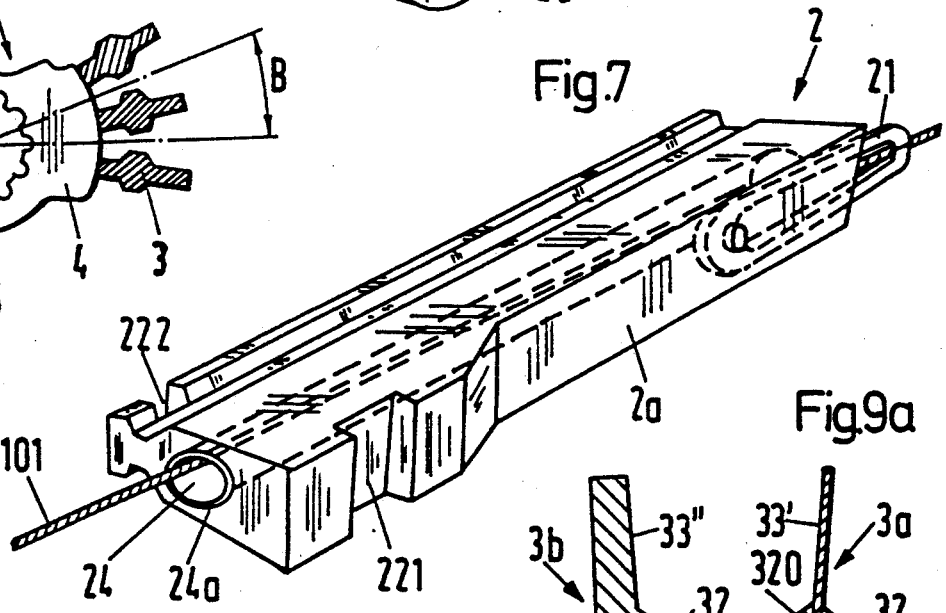
Fig.7
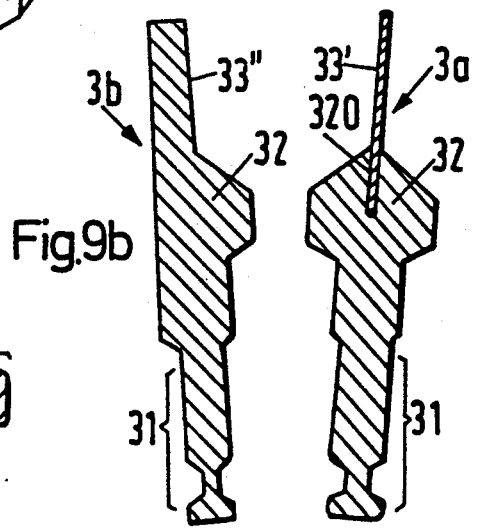
Fig.9a
Fig.9b
Fig.8
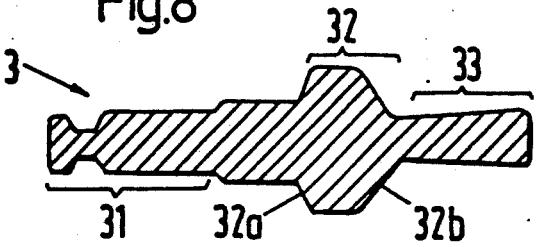

GRIPPER CHANGER FOR PROJECTILE LOOMS

BACKGROUND OF THE INVENTION

The invention relates to a weft yarn changer on a projectile loom and to a projectile loom having such a weft yarn changer.

By means of a yarn transfer element forming part of the weft yarn changer and conventionally known as a yarn giver or retractor the tip of the weft yarn near the cutters is moved in front of the shed after picking and, by means of a yarn tensioner, drawn back and by means of the same yarn transfer element or in the event of a yarn change by means of some other yarn transfer element the yarn for the next pick is transferred to the projectile by means of gripper openers. The changer member has guideways or slideways for the yarn transfer elements. When the same are in their withdrawn position a required colour or weft yarn change can be made by pivoting the changer member through one or more steps.

In the course of projectile loom development, which led to over-increasing productivity inter alia because of increasing loom speeds, no outstanding improvements were needed for a long time to the weft yarn changers of multicolor looms (cf. DE-PS 942979). In the end, however, the weft yarn changer turned out to be a speed-determining element. It became necessary, more particularly in the case of fabrics having e.g. four weft colors, where the color sequence called for maximum pivoting movements of the changer, to reduce loom speed considerably below that of two-color or mixing changer looms. This led to the patterns of some fabrics being so modified that color changing involving extreme changing steps was avoided with a view to greatly reducing changer strokes and thus enabling loom operating speeds to be higher. The resulting limitation of color selection meant of course that the problem was not solved satisfactorily. The solution of the problem had to be looked for in an improvement of the loom.

SUMMARY OF THE INVENTION

Clearly, if actuating times are to be reduced the moment of inertia of the changer, the weight of the yarn transfer elements and the steps of the pivoting movement need to be reduced. The problem which the invention intends to solve is so to improve the weft yarn changer in respect of these requirements that the novel changer can replace the conventional changers of existing looms.

BRIEF DESCRIPTION OF THE DRAWINGS

FIG. 1*a* schematically illustrates the important components for picking of a single-color projectile loom at the instant of yarn transfer to the projectile;

FIG. 1*b* is a view similar to FIG. 1*a* during retraction of the weft yarn tip;

FIG. 2 is a perspective view which shows a pivotable changer member of a conventional four-color loom;

FIG. 3 is a perspective view which shows a known yarn transfer element;

FIG. 4 is an elevation view in cross-section of the changer member of FIG. 2;

FIG. 5 is a perspective view which shows a changer member according to the invention with yarn transfer elements of which only the slide rods are shown in simplified form;

FIG. 6 is an elevation view in cross-section of the changer member of FIG. 5;

FIG. 7 is a perspective view which shows a yarn transfer element according to the invention;

FIG. 8 is an elevation view in cross-section of a guide lamella of the changer member of FIG. 5;

FIG. 9*a* is an elevation view in cross-section of a second guide lamella; and

FIG. 9*b* is a view in cross-section of a possible edge type guide lamella.

DESCRIPTION OF THE PREFERRED EMBODIMENTS

In FIGS. 1*a* and 1*b* there can be seen in diagrammatic form a yarn supply 100, a weft yarn 101, a yarn brake 130, a yarn tensioner 140, a yarn gripper 21 of the yarn transfer element (not shown), a projectile 120 which moves on a flight path 102 after picking, a shed 110 with fabric or cloth 111, an edge yarn clamp 150 and cutters 160. In FIG. 1*a* the tip of the weft yarn 101 is being transferred to the projectile 120 as a result of the gripper 21 opening and of the projectile gripper closing. In FIG. 1*b* the weft yarn 101 is being caught by the edge yarn clamp 150 and the gripper 21, which has moved towards the shed, and is being severed by the cutters 160, whereafter, by the co-operation of the tensioner 140 and with the brake 130 applied, the weft yarn 100 can be drawn back by the yarn transfer element.

FIG. 2 shows a part of a four-color changer having a changer member 11 secured to a pivotable stop plate 17 (illustrated in simplified form) and which can be moved by means of a drive (not shown), a bevel gear 15 and a shaft 16. At the rear of the plate 17 there are grooves 18 in which a lever of a stop device (not shown) can engage and abruptly stop the movement of the changer in a predetermined position. Guide bars 12 of the changer member 11 are effective as the slideways 13 of the yarn transfer elements. One such yarn transfer element 20 is shown in FIG. 3 which illustrates a yarn transfer to the projectile 120 such as corresponds to FIG. 1*a*. In FIG. 2 the position 120' taken up by the projectile 120 and the position 20' of the longitudinal axis of the yarn transfer element 20 are shown in chain-dotted lines.

At its rear end the element 20 is formed with two grooves—a groove 221 for an abutment (not shown) for driving the retracting movement and a groove 222 in which a locking plate engages when the element 20 is not in the transfer position. As shown in FIG. 3, the gripper 21 can be opened by means of a reciprocating gripper opener 25. A part of the picking stick which picks the projectile moves in the longitudinal groove 223.

Referring to FIG. 4, the angle A through which the changer 10 pivots in a single step is shown for the cross-sectional shape of the changer member 11. The stop grooves 18 and other details are not shown. The size of the angle A is determined by the opener 25 and by the grippers 21 themselves. During yarn transfer to the projectile 120 the opener 25 must not touch the grippers 21 of the adjacent transfer elements 20.

To replace a conventional changer by a device improved in accordance with the invention, existing conditions of space must be complied with. This means that the pivoting radius of the element 20, more particularly of the gripper 21, must be maintained for the position of yarn transfer to the projectile 120 to remain at the original place.

A first aim in improving the changer is to reduce the angle A of the working step. This is achieved by action affecting the opener 25. Conventional looms use for yarn transfer to the projectile (FIG. 1*a*) and for yarn tip retraction (FIG. 1*b*) a pair of gripper openers 25 which are rigidly interconnected and which are reciprocated by the same drive. Consequently, one opener 25 extends into the flight path of the projectile 120, and so the fork opening of the opener 25 must be large enough for the projectile 120 to pass through such opening without hindrance. If the pair of openers are driven to opposite hands in the manner known from CH-PS 325 050 and if, for example, yarn grippers 21 are used which are opened by spreading the gripper arms apart from one another by means of wedge-shaped gripper openers introducible between the arms, the openers can be smaller and so the angle A—i.e., the working step of the changer—can be reduced.

Another step for accelerating changer movement relates to the drive of the projectile 120. In conventional looms the picking stick previously referred to herein in connection with FIG. 3 is driven by a picking lever by way of a connecting link, rotation of the picking lever being converted into a linear movement by means of a straight guide path. As already known (cf. EP-A 0 333 647), the picking lever can be so devised with an end member that the same can act directly on a struck surface of the projectile 120. The end member, for example, in the form of a striking roller, replaces the picking stick and takes up much less space than the latter. More particularly, the longitudinal groove 223 in the yarn transfer element 20 (see FIG. 3) ceases to be necessary, with the advantageous consequence that a changer stroke can be initiated during the retraction movement of the element 20. In conventional looms a changer stroke can be initiated only after completion of the retraction movement.

The features described, together with further considerations of the problem which the invention intends to solve, have led to the weft yarn changer 1 according to the invention which is shown as an embodiment in FIG. 5, the yarn transfer element 2 (see FIG. 7) being shown in simplified form as a rod 2'. In addition to the rods 2' the device comprises guide lamellae 3, the two plastics holders 4 and the carrier 5 which in this example is a drive shaft. For reliable transmission of the torque from the drive shaft 5 to the holders 4 their surfaces have longitudinal ribs to give a splined shaft effect. The reciprocation of the slide rods and the pivoting of the shaft 5 are indicated by double arrows D and C respectively.

FIG. 6 is a view similar to FIG. 4 showing the cross-sectional shape of the changer member 1*a* according to the invention and the partly shown holder 4 having three of a total of five guide lamellae is visible. The angle B allocated to a working step is appreciably smaller than the corresponding angle A of the known changer, having been reduced by approximately 26° to 20°.

The perspective view of FIG. 7 shows the yarn transfer element 2 according to the invention in greater detail. Disposed at its rear end are grooves 221, 222; as in the conventional changer one groove is associated with the entraining abutment and the other with the locking plate. The yarn gripper 20 is introduced at the front in a pocket-like cavity and secured. As previously stated, the gripper 21 is adapted to be opened by means of a wedge-shaped opener adapted to spread the two arms of the gripper apart from one another.

In contrast to the conventional changer, the cross-section of the slide rod 2*a* is longer radially than tangentially in the pivoting direction as referred to the pivoting axis. This shape, despite a reduction in the step angle of approximately 20%, provides stable straight guiding of the yarn transfer element 2, an important consideration so far as reliable retraction of the yarn transfer element 2 is concerned. This stable straight guidance is not greatly impaired by an axial duct 24. In the first place, the cavity represented by the duct 24 reduces weight. The duct 24 is particularly suitable as a yarn guide and it is also a significant feature as regards production of the slide rod 2*a* by injection moulding.

The slide rod 2*a* is injection moulded from a mixture of plastics and short reinforcing fibres, the plastics preferably being polyetheretherketon and the fibres preferably being carbon fibres. Advantageously, a mould into which a tube 24*a* for forming the duct 24 can be placed is used. The injection moulding step produces a plastics member sheathing the tube 24*a*. Preferably, a pultruded tube 24*a* reinforced with long carbon fibres is used for a tube of this kind is very rigid and therefore contributes substantially to the stable straight guidance of the rod 2*a*. The tube ends where the weft yarn is deflected are advantageously strengthened by eyes or the like of ceramic or hard metal (not shown). A thin-walled aluminium tube, for example, might be used instead of the plastics tube 24*a*.

The use of the polyetheretherketon plastics makes it possible to omit lubrication of the yarn transfer elements 2 sliding between the lamellae 3, thus obviating one source of dirt which might impair cloth quality. The use of plastics helps to provide an approximately 40% weight reduction of the yarn transfer element 2 (with a steel gripper 21) as compared with the conventional yarn transfer element 20. The gripper 21 too can be made of carbon-fibre-reinforced plastics to achieve a further weight reduction.

The guide lamella 3 is a lamella-like profiled rod whose cross-section is shown in FIG. 8. It has three main parts—a base zone 31 to which it is connected by way of at least one holder 4 (see FIG. 5), a slide bar 32 having two surfaces 32*a*, 32*b* effective as main guides of the rods 2*a*, and a partition 33 which separates adjacent transfer elements 2 and is also effective as a supporting guide. Advantageously, the holder 4 is injection moulded, for example, from polyethersulphone (PES), the base zones 31 of the lamellae 3 preferably being injected during the production of the holder 4, as shown by way of indication in FIG. 5.

Since they provide a support and guiding function, the lamellae 3 are made of metal, for example, a structural alloy steel, such as the alloy steel described in German Industrial Standard ("DIN") No. 17,006 and identified as 90MnCrV8, with at least some hardening of the surfaces, more particularly near the bars 32, or of an aluminum alloy, also with at least some hardening of the surfaces by hard anodising. Alternatively, the lamellae 3 can be made of metal-coated plastics. These lamellae 3 are effective as abrasion-resistant companion elements to the yarn transfer elements 2.

Since the changer member 1*a* (FIG. 6) is divided up into components, viz. into lamellae 3 and holders 4 which can be made of substances appropriate to their particular duties, the moment of inertia of the changer member 1*a* can be reduced considerably. Also, it becomes possible to use a production process enabling the required straight guidance of the yarn transfer elements 2 to be achieved economically since the guide lamellae 3 are simple to machine.

Instead of the lamellae 3 being secured by means of two holders 4 to the drive shaft as in the embodiment shown in FIG. 5, only a single holder or more than two holders can of course be provided. Instead of the drive shaft the carrier 5 can take the form of a stationary spindle, in which event the holders are releasably connected to the carrier and the torque is applied to the changer member 1*a*, for example, by way of the or each holder.

The partition 33 of the lamella 3 can be solid, as shown in FIG. 8, or thin, for example, thinner than 0.5 mm, as shown in FIG. 9*a*. In the latter case the partition 33′ has merely a separating function, the support function being provided in this case by way of the adjacent slide bars 2*a*. However, this applies only to the inner guide lamellae 3*a* (FIG. 9*a*) and a solid support wall 33″ must be provided for the edge guide lamellae 3*b* (FIG. 9*b*). As shown in FIG. 5, the partition 33 can be formed with a central recess.

The partition 33′ can be a foil-like strip clamped in a slot-like groove 320 in the slide bar 32. Partitions 33′ can be omitted so that adjacent slide bars contact one another supportingly. Advisably in this case, one of the contact surfaces is made of metal. For example, every other slide bar 2*a* can be metal-coated or each slide bar 2*a* can have a metal strip on one side. If thin partitions 33′ are used or if partitions 33′ are entirely omitted, the angle B associated with a working step can be further reduced from 20° to 16°.

What is claimed is:

1. A weft yarn changer system for a projectile loom, the system comprising a change member (1) pivotable about a pivot axis and mounting at least two yarn transfer elements (2) each defining a slide rod (2*a*) and a yarn gripper (21), slide bars for the yarn transfer elements (2) provided on the change member (1), at least one lightweight plastics holder (4), and a tube (5) effective as drive shaft of the changer member (1) or as pivot spindle, the holder connecting the slide bars with the tube.

2. A weft yarn changer according to claim 1, wherein the slide bars each define a lamella-like profiled bar (3) having a bottom zone (31) for connection to the holder (4).

3. A weft yarn change according to claim 2, wherein at least one of the holders (4) is injection molded, and wherein the bottom zone (31) of the guide lamellae (3) are connected to the holder (4) by injection molding.

4. A weft yarn changer according to claim 1, wherein at least one of the holders (4) is made of polyethersulphone (PES).

5. A weft yarn changer according to claim 1, wherein two holders secure the slide bars to the drive shaft (5).

6. A weft yarn changer according to claim 1, wherein the slide bars include top zones forming a partition between adjacent slide bars (2*a*).

7. A weft yarn changer according to claim 6, wherein the top zone (33) is formed with at least one centrally disposed recess.

8. A weft yarn changer according to claim 6, wherein the partition is lamella-like and thinner than 0.5 mm.

9. A weft yarn changer according to claim 1, wherein the slide bars (3) are made of steel and wherein the slide bars have surfaces which guide the slide rods and which are hardened.

10. A weft yarn changer according to claim 1, wherein the slide bars are made of an aluminum alloy and have surfaces which guide the slide rods and are hardanodized.

11. A weft yarn changer according to claim 1, wherein the slide bars are made of plastics and have surfaces which guide the slide rods and are metal-coated.

12. A projectile loom comprising a weft yarn changer system including a change member (1) pivotable about a pivot axis and mounting at least two yarn transfer elements (2) each defining a slide rod (2*a*) and a yarn gripper (21), slide bars for the yarn transfer elements (2) provided on the change member (1), at least one lightweight plastics holder (4), and a tube (50 effective as drive shaft of the changer member (1) or as pivot spindle, the holder connecting the slide bars with the tube.

* * * * *